M7219 XR 4,167,213

United States Patent [19]

Stoltz et al.

[11] 4,167,213

[45] Sep. 11, 1979

[54] METHOD FOR DETERMINING THE POSITION AND INCLINATION OF A FLAME FRONT DURING IN SITU COMBUSTION OF A RUBBLED OIL SHALE RETORT

[75] Inventors: Richard A. Stoltz, Murrysville, Pa.; Albert C. Metrailer, Broken Arrow, Okla.

[73] Assignee: Standard Oil Company (Indiana), Chicago, Ill.

[21] Appl. No.: 925,064

[22] Filed: Jul. 17, 1978

[51] Int. Cl.[2] ..... E21B 43/24; E21B 47/12

[52] U.S. Cl. ..... 166/251; 166/259; 166/65 R; 299/2

[58] Field of Search ..... 166/251, 250, 256, 65 R, 166/66, 272; 73/151; 181/101, 102; 299/2

[56] References Cited

U.S. PATENT DOCUMENTS

| | | | |
|---|---|---|---|
| 3,031,762 | 5/1962 | Parker | 166/251 X |
| 3,483,730 | 12/1969 | Gilchrist | 73/15 |
| 4,082,145 | 4/1978 | Elkington | 166/251 |
| 4,120,354 | 10/1978 | Ridley et al. | 166/251 |

OTHER PUBLICATIONS

Van Poollen, "Transient Tests Find Fire Front in an In-situ Combustion Project", The Oil and Gas Journal, Feb. 1, 1965, pp. 78–80.

*Primary Examiner*—Stephen J. Novosad

*Attorney, Agent, or Firm*—Robert B. Stevenson; Arthur McIlroy

[57] ABSTRACT

A passive method for locating the position and inclination of a flame front, within an oil-shale retort of known dimensions and location during an in situ combustion of the retort involving detecting the sound generated by the flame front, by two matched detectors separated by a fixed known distance. The pair of matched detectors are suspended vertically in a liquid-filled well which was drilled essentially parallel to the side wall of the retort. The outputs of the two detectors are fed directly to a differential amplifier and the resulting difference signal is monitored as a function of depth as the pair of detectors are raised and/or lowered in the well. The minimum in this signal corresponds to the position of the flame front within the retort. Repeated measurements in various observation wells establish the inclination of the flame front.

6 Claims, 3 Drawing Figures

METHOD FOR DETERMINING THE POSITION AND INCLINATION OF A FLAME FRONT DURING IN SITU COMBUSTION OF A RUBBLED OIL SHALE RETORT

BACKGROUND OF THE INVENTION

1. Field of the Invention

This invention relates to the detection and control of a combustion or flame front being advanced through a subterranean combustible carbonaceous stratum. Specifically, this invention relates to the detection and control of a combustion or flame front during the utilization of in situ combustion techniques. More specifically, this invention relates to detection and control of a frame front during an in situ retorting of oil shale.

2. Description of the Prior Art

The term oil shale refers to sedimentary deposits containing organic materials which can be converted to oil. Oil shale contains an organic material called kerogen, which is a solid carbonaceous material from which shale oil can be retorted. Upon heating oil shale to a sufficient temperature, kerogen is decomposed and a liquid and/or gaseous hydrocarbon product is formed.

Oil shale can be found in various places throughout the world, especially in Colorado, Utah, and Wyoming. Some significant deposits can be found in the Green River formation in Piceance Basin, Garfield and Rio Blanco counties in northwestern Colorado.

Oil shale can be retorted to form hydrocarbon liquid either by in situ or surface retorting. In surface retorting, oil shale is mined from the ground, brought to the surface, and placed in vessels where it is contacted with hot retorting gases. The hot retorting gases cause shale oil to be freed from the rock. Spent retorted oil shale, which has been depleted in kerogen is removed from the reactor and discarded.

In situ combustion techniques are being applied to shale, tar sands, Athabasca sand and other strata in virgin state, to coal veins by fracturing, and to strata partially depleted by primary and even secondary and tertiary recovery methods.

In situ retorting oil shale generally comprises forming a retort or retorting area underground, preferably within the oil shale zone. The retorting zone is formed by mining an access tunnel to or near the retorting zone and then removing a portion of the oil shale deposit by conventional mining techniques. About 5 to 40%, preferably about 15 to 25%, of the oil shale in the retorting area is removed to provide void space in the retorting area. The oil shale in the retorting area is then rubbled by well known mining techniques to provide a retort containing rubbled shale for retorting.

A common method for forming an underground retort is to undercut the deposit to be retorted and remove a portion of the deposit to provide void space. Explosives are then placed in the overlying or surrounding oil shale. These explosives are used to rubble the shale preferably forming a uniform particle size. Some of the techniques used for forming the undercut area in the rubbled area are room and piller mining, sublevel caving, and the like.

After the underground retort is formed, the pile of rubbled shale is subjected to retorting. Hot retorting gases are passed through the rubbled shale to effectively form and remove liquid and gaseous hydrocarbons from the oil shale. This is commonly done by passing a retorting gas such as air or air mixed with steam and/or hydrocarbons through the deposit. Most commonly, air is pumped into one end of the retort and a fire or flame front initiated. This flame front is then passed slowly through the rubbled deposit to effect the retorting. Not only is shale oil effectively produced, but also a mixture of off gases from the retorting is formed. These gases contain carbon monoxide, ammonia, carbon dioxide, hydrogen sulfide, carbonyl sulfide, and oxides of sulfur and nitrogen. Generally, a mixture of off-gases, water and shale oil are recovered from the retort. This mixture undergoes preliminary separation commonly by gravity to separate the gases, liquid oil, and water. The off-gases commonly contain entrained dust and hydrocarbons, some of which are liquid or liquifiable under moderate pressure, the off-gases usually have a very low heat content of less than about 100 to about 150 BTU per cubic foot.

One problem attending shale oil production in in situ retorts is that the flame front may channel through more combustionable portions of the rubble faster than others. The resulting uneven passage of the flame front can leave considerable portions of the rubbled volume bypassed and unproductive. Such channeling can result from non-uniform size and density distributions in the rubbled shale. If the shape of the flame front can be defined or packing variations detected within the retort, then channeling and its effects can be mitigated by controlling the air injection and the oxygen content in various sectors of the retort, or secondary rubbling if regions of poor density can be mapped.

A variety of prior art techniques have been established for determining the position and progress of underground combustion. These techniques range from indirect theoretical mathematical formulations on one hand, to rather simplistic direct measurement that can be done at the combustion site on the other. One example of the mathematical treatment can be found in a paper by Hosslin Kazemi, delivered in 1965 at the Society of Petroleum Engineers Conference. Kazemi disclosed a method by which the distance from the measuring point to the combustion front could be calculated employing pressure transient measurements. In particular, the pressure fall-off observed at the bottom of the well hole in either injected liquid or in effluent gases could be related to the approach of the combustion front. Such pressure build-up and fall-off measurements were also described by H. K. Van Poolen in the Feb. 1, 1965, *Oil and Gas Journal.*

An equally elaborate technique was described by Dr. Feder in 1967 using an infrared system to locate subterranean thermal front when an infrared sensor is flown over the investigated area. Thermal energy from a subsurface heat source (combustion or steam fronts) may be transferred to the terrain surface by conduction through the overburden formation, or by movement of heated water or gases to the surface via fractures. Infrared imaging would then be useful to identify the hot portions of the surface terrain. This method however, is only a gross estimate for the position of the underground thermal front, and does not determine the position of the flame front with sufficient accuracy to determine channeling or inclination of the flame front.

U.S. Pat. No. 3,031,762 discloses the periodic measurement of the elevation of the ground at one or more points directly above the path of a combustion front until the ground at this point rises. Such a rise is interpreted to indicate the arrival of the combustion front directly under the elevated point. This method is dependent on the fact that combustion of carbonaceous stratum causes expansion of the stratum which is substantially immediately translated to a rise in the elevation of the ground surface directly above the expansion stratum. This method is uniquely applicable to combustion fronts which are primarily vertical and which move in a horizontal direction. Combustion fronts in the horizontal plane that propagate vertically would simply result in a roughly symmetrical elevated area with no information provided considering the depth or speed of the front.

U.S. Pat. No. 3,072,184 discloses a fuel pack in which separate masses of gas forming material are spaced in the fuel pack at predetermined distances. Thus as the fuel pack burns, it releases identifiable gases at spaced intervals which, when detected in the effluent gases can be related to the progress of the combustion front in that particular fuel pack. This method is primarily useful in well bores and is not readily amenable to application in underground retorting.

U.S. Pat. No. 3,454,365 discloses a method in which the gas from in situ combustion process is analyzed for its oxygen, carbon dioxide, hydrogen and hydrocarbon content. A small sample stream from a hot effluent during in situ combustion is treated, condensed and dried. It is subsequently analyzed to determine the relative concentrations of the various off-gases. This concentration level is then rationalized through a control computer which controls the air injection rate to maintain an optimum utilization of the oxygen in the air stream and to optimize the in situ cracking process. This process is directed primarily towards detecting the efficiency or effectiveness of the combustion process within the retort, and does not provide usable information concerning the speed, progress, extent or location of the flame front within the retort.

U.S. Pat. No. 3,467,189 also employs a sample-and-analyze technique to detect the approach of the flame front. Physical properties such as the water to air ratio of the formation fluids which enter a production well are monitored, as well as the hydrogen ion concentration and the salinity of the water and the specific gravity of the liquid hydrocarbons. A signal indicating the close proximity of the combustion front to the production well is provided when limiting or static values are reached at the same time in any two of the physical properties of the formation fluids entering the production valve.

U.S. Pat. No. 3,483,730 employs thermocouples to monitor the change in temperature of the overburden near the ground surface at a plurality of points spaced around the point at which the combustion is initiated. These thermocouples respond to changes in the temperature of the overburden during movement of the underground combustion and thereby detect lateral displacement of the flame front.

Related to the teachings of U.S. Pat. No. 3,483,730 is a method involving a downhole placement of temperature-sensing devices which indicate a sharp rise in temperature as the flame front arrives at the locus of the temperature-sensing device. One disadvantage in this method lies in the fact that the extremely high temperatures of the combustion front frequently destroy the temperature-sensing apparatus. Another disadvantage is in the cost of drilling holes to the formation level.

The techniques of self-potential profiling, long used to locate mineral deposits, has recently been found to be useful as a tool for locating buried geothermal reservoirs. This technique involves the detection of small self-potential voltages, which result from natural earth currents. Two metal stakes are placed in conductive ground and connected to a sensitive voltmeter which detects the generation of electromotive force in the surrounding rocks due to increase in temperature. The effective range of this method is somewhat limited and dependent upon a large area of thermal variation to generate a measureable voltage. In an underground retort however, very poor electrical coupling exists between the rubble and the retort walls. Any self-potential voltages generated within the retort will be poorly transmitted to the walls. Therefore, self-potential voltages detectable by the surface sensors will be primarily those generated from the immediate adjacent retort walls (a much smaller thermal source than the entire flame front). This significantly reduces the efficacy of this method in underground retorting. Like the infrared imaging technique, this method adequately detects the presence of thermal anomalies, but provides little information concerning the depth or movement of such thermal fronts.

Scientists at the Lawrence Livermore Laboratories have recently explored the use of high frequency electromagnetic probing to investigate underground anomalies. One application of the radio frequency (RF) probing is to observe the progress of a burn front in the experimental underground coal gasification process. This technique involves lowering radio transmitters and receivers into bore holes drilled around the area of concern. Underground irregularities which have an effect on the passage of the RF waves can then be detected and located. Varying geological features, however, also affect the passage of RF waves. In addition, underground water pockets, or any other interface causing a change in the dielectric constant, would also affect the passage of RF waves. This method is therefore susceptible to interference caused by the presence of normal subterreanen features.

It can be seen that the methods taught by the prior art are, in general, directed towards either (1) detecting lateral movement of a flame front, or (2) the vertical movement of a flame front, but not both. In addition, even those methods which are capable of detecting directional movement and location of the front do not provide means for ascertaining whether the front is tilted out of the desired orientation. Such tilts are undesirable as they can cause incomplete or inefficient combustion in the retort. In general, the prior art does not provide a means for detecting both lateral and vertical locations of a flame front, the speed with which the flame front is propagating through the carbonaceous stratum and the degree to which the front deviates from the desired horizontal or vertical plane. Once these parameters in the underground flame front are detected, various means can be employed to selectively speed up or hinder portions of this flame front to more efficiently effectuate the retorting process.

This invention is concerned with a method of determining the progess and pattern of a combustion front in a carbonaceous stratum which avoids the aforesaid difficulties.

SUMMARY OF THE INVENTION

In accordance with this invention, there is provided a passive method of determining the position and inclination of a flaming front being propagated through a rubbled oil shale retort during an in situ combustion of the retort. The rubbled oil shale retort being monitored in the present invention is envisioned as a well defined, carefully prepared underground rubbled zone of oil shale surrounded by an undisturbed oil shale deposit. As such, the position and the dimensions of the retort are known. Accordingly, the acoustic energy generated by the flame front present within this burning retort is detected at a plurality of positions which are known relative to the rubbled oil shale retort. From these received signals the position of the source of the acoustic energy, the flame front, is determined.

In one embodiment of the invention, a pair of matched seismic detector means separated by a fixed known distance are moved through a well bore which has been drilled such as to traverse, at a known distance thereto a sidewall of the retort which was selected because the flame front is intended to pass along this sidewall during the in situ combustion. In this embodiment, the output signals from the pair of matched seismic detectors are lead to a differential amplifier and the resulting difference signal is recorded as a function of the position of the pair of detectors in the well bore. As the pair of detectors move past the flame front, a relative minimum in the recorded difference signal will occur which identifies the position of the flame front. Repeating this process in more than one well bore will establish the inclination of the flame front within the retort.

In another embodiment of the invention, a plurality of seismic detectors are positioned along a line on the earth's surface that is essentially perpendicular to the plane of the underground oil shale retort sidewall. The received acoustic signals are analyzed by means of a receiver-to-receiver cross-correlation to determine time shifts which with the known position of the detectors allows the depth of the flame front to be determined.

In still another embodiment, one detector is placed on the earth's surface directly above the flame front in the plane of the retort sidewall and a second detector is placed on the earth's surface displaced to the formation side of the sidewall. Preferably, the second detector is a group of seismometers placed in an arc which is focused at the sidewall. In this embodiment, the composite seismic signal from the detectors focused at the retort sidewall is cross-correlated with the single detector signal from above the retort, such that a time shift is determined. This time shift along with an average sonic velocity where combined with the known position of the detectors leads to a determination of the depth or position of the flame front. Again, repeated application of various embodiments or their combination at various sidewalls will resolve in determining the inclination of the fire front.

DECRIPTION OF THE PREFERRED EMBODIMENTS

Figure 1:
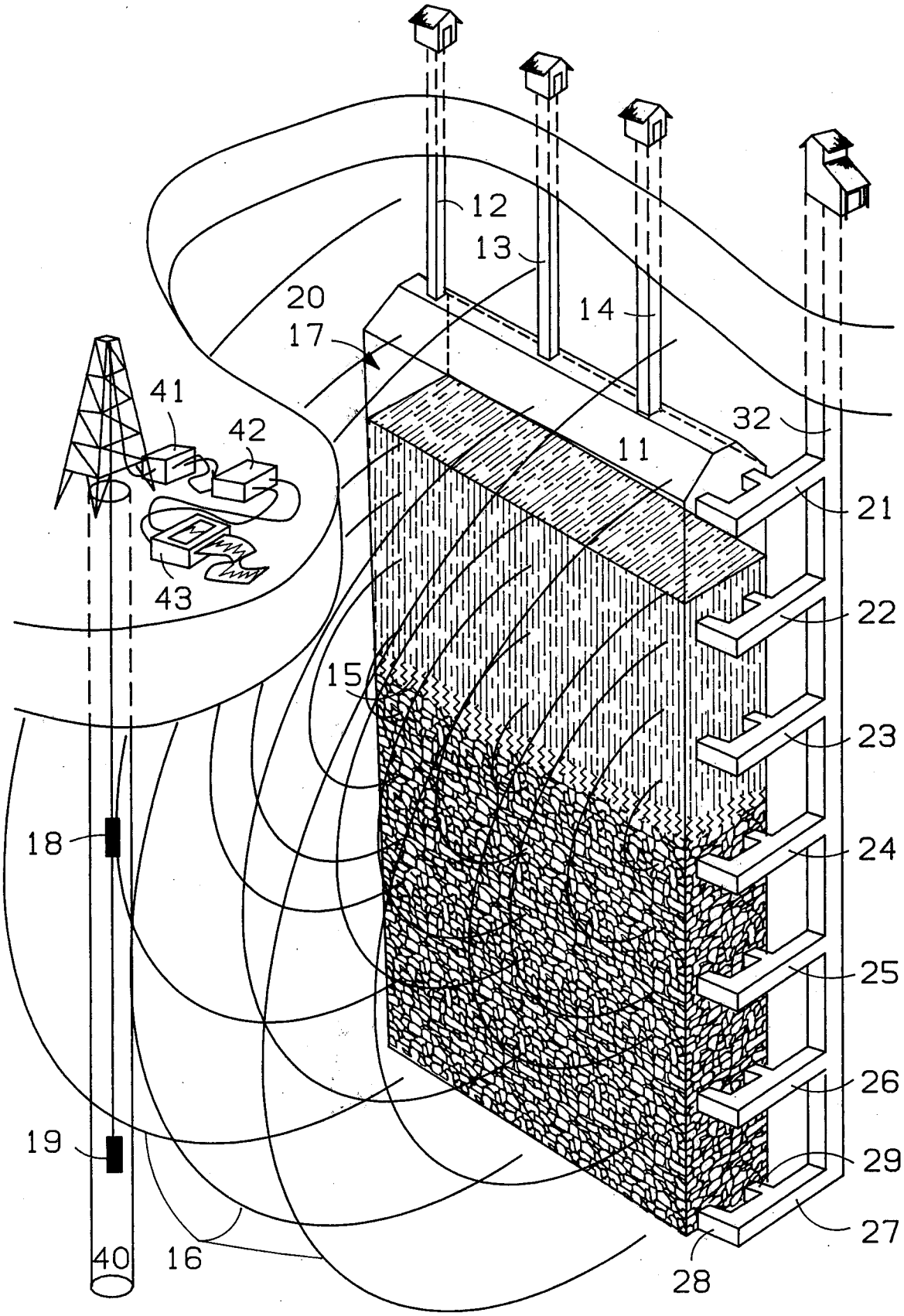
FIG. 1 is a cutaway view illustrating a subterrenean oil shale formation containing a rubbled oil shale retort during in situ combination wherein the position of the flame front within the retort is being monitored by a pair of matched hydrophones separated by a fixed distance and being raised and lowered in an adjacent fluid-filled observation well.

In FIG. 1, there is shown an underground oil shale retort 11 located in an oil shale stratigraphic deposit 20 in which as in situ combustion process to recover liquid and gaseous hydrocarbons is taking place.

The retort is of known dimensions and positions in that it was initially created by mining approximately 20% by volume of the shale deposited within the retort by use of mine shafts 21 through 27 located at various depths. The actual construction of the rubbled retort can be done by conventional mining techniques well known in the art. In general, the respective mine shafts are built with one or more horizontal drift (e.g., 28 and 29) being driven through the width of the retort. A vertical starting slot to provide a free blasting surface is drilled at the far end of each of the drifts. Fan drilling vertically upward and blasting to create the rubbled zone is performed as the withdrawal from the drift takes place. This process is then repeated on the next lower level until the entire rubbled retort is established. The volume of shale removed, in principal, establishes the net void space (porosity or density) of the resulting retort. The particle size of the rubble is controlled by drilling and blasting parameters with a two foot or less particle size being desirable.

Oxygen for the in situ combustion is supplied by pumping air from the surface through shafts 12, 13, and 14 to the top of the retort 11. During combustion, a horizontal flame front 15 is sustained which moves downward through the rubbled oil shale retort. The hot combustion products from the flame front move downward heating the oil shale to a temperature of about 900° F. which results in kerogen releasing gaseous and liquid hydrocarbons which are then swept downward through the retort leaving a coke like structure behind. The hydrocarbons are recovered at the lowest level, 27, and are delivered back to the surface via mine shaft 32. Preferably, the hydrocarbon can be separated below the ground (not shown) prior to being pumped to the surface for further treatment. The remaining coke-like material serves as the fuel to sustain the flame front.

As shown in FIG. 1, the flame front as it passes through the retort is (in and of itself) a seismic source generating acoustic energy 16 which radiates away from the intersection of the flame front 11 and the retort sidewall 17. The sound is believed to result primarily from fracturing of the consolidated sidewall 17 caused by large thermal gradients. This sound generated by the presence of the flame front is detected by a pair of seismic detectors 18 and 19 suspended in a well bore 40 and separated from each other by fixed known distance. The detectors are preferably preselected such that their respective response to acoustic energy are matched as closely as possible. The output signals from the pair of detectors are sent to a differential amplifier 41 wherein the difference between the individual response signals is amplified and then amplitude detected by detector 42 and then sent to script recorder 43. The pair of matched detectors are moved up or down the well bore 40 traversing the sidewall of the retort 11. Simultaneously, the depth of the detectors in the well bore and the amplitude of the difference signal are recorded at the script recorder 42. A minimum in the script recording of the difference signal corresponds to the two detectors being equal distance acoustically from the source of the sound (the flame front). Thus, the depth of the detectors in the well bore at this minimum in the difference signal corresponds to the position of the flame front in the retort. Alternatively, a string of seismometers may be positioned in a borehole with pairs connected sequentially to the two inputs of the differential amplifier. Acoustic signal amplitude at a given depth is then sampled by selection of the appropriate detector pair rather than by moving a single pair.

Figure 2:
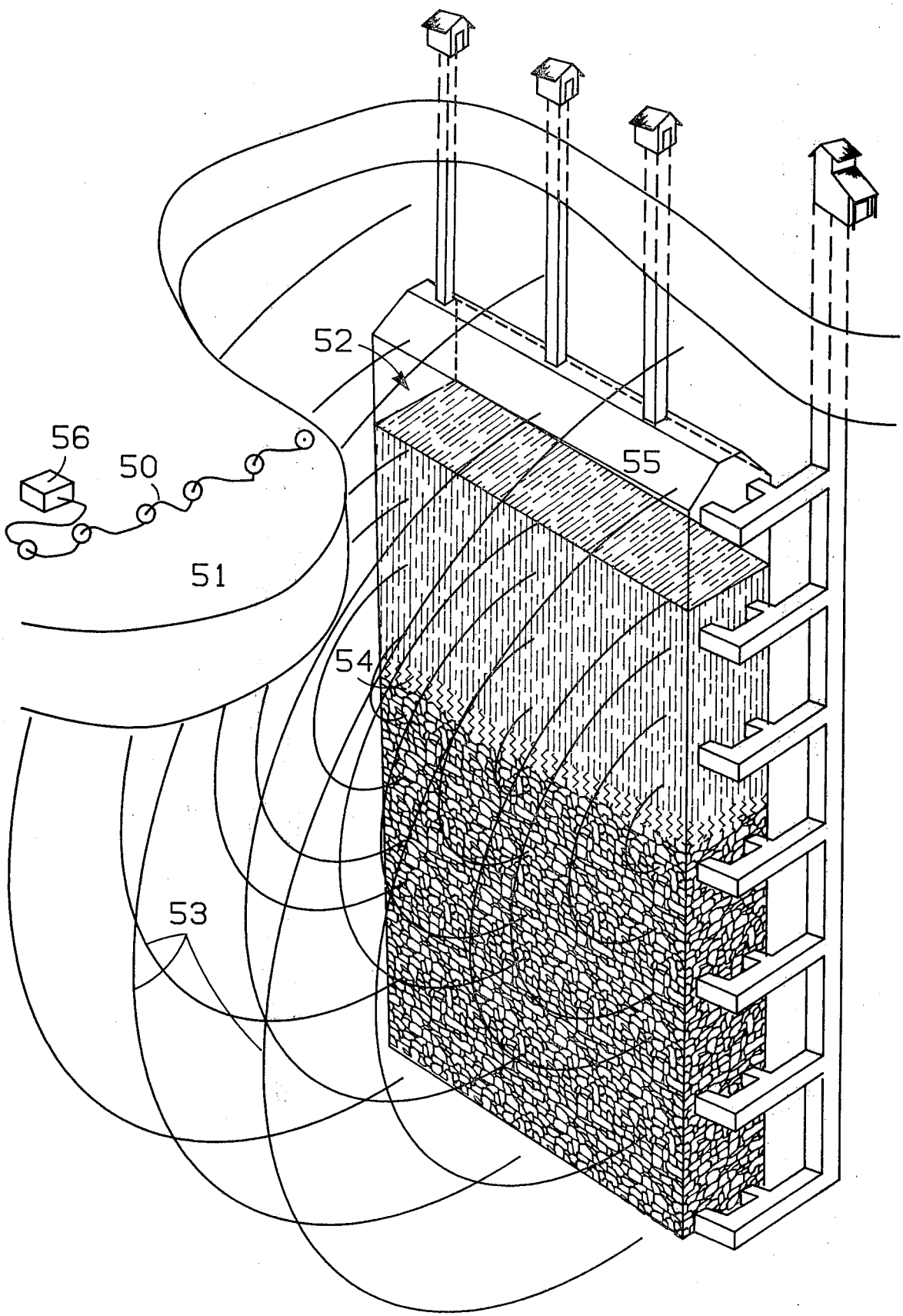
FIG. 2 is a cutaway view illustrating the determining of the position of the flame front during in situ combustion using a series of seismometers placed on the earth's surface in a line perpendicular to the plane of the oil shale retort sidewall.

In FIG. 2, a string or array of at least three detectors 50 are arranged on the earth's surface 51 in a line directed such that it is perpendicular to the plane of the retort sidewall 52. The sound 53 radiating from the flame front 54 within the rubbled retort 55 is received at the surface as a function of time and consequently processed by a dedicated computer 56. After cross correlation of the respective seismic signals received at each receiver, the respective delay times associated with receiver positions are used to calculate the incremental distance each respective detector is from the acoustic source. Since the position of the detectors 50 are known to be positioned normal to the side of the rubbled retort 55, the respective incremental distances (time delays) will triangularize back to a common region on the rubbled retort sidewall, thus determining the position of the flame front. As illustrated in FIG. 2, none of the detectors 50 is positioned directly above the sidewall of the retort. As a result, both lateral distance to the sidewall and depth to the flamefront are unknown. At least three detectors are needed to provide two time differentials which then allow determination of both unknowns.

Figure 3:
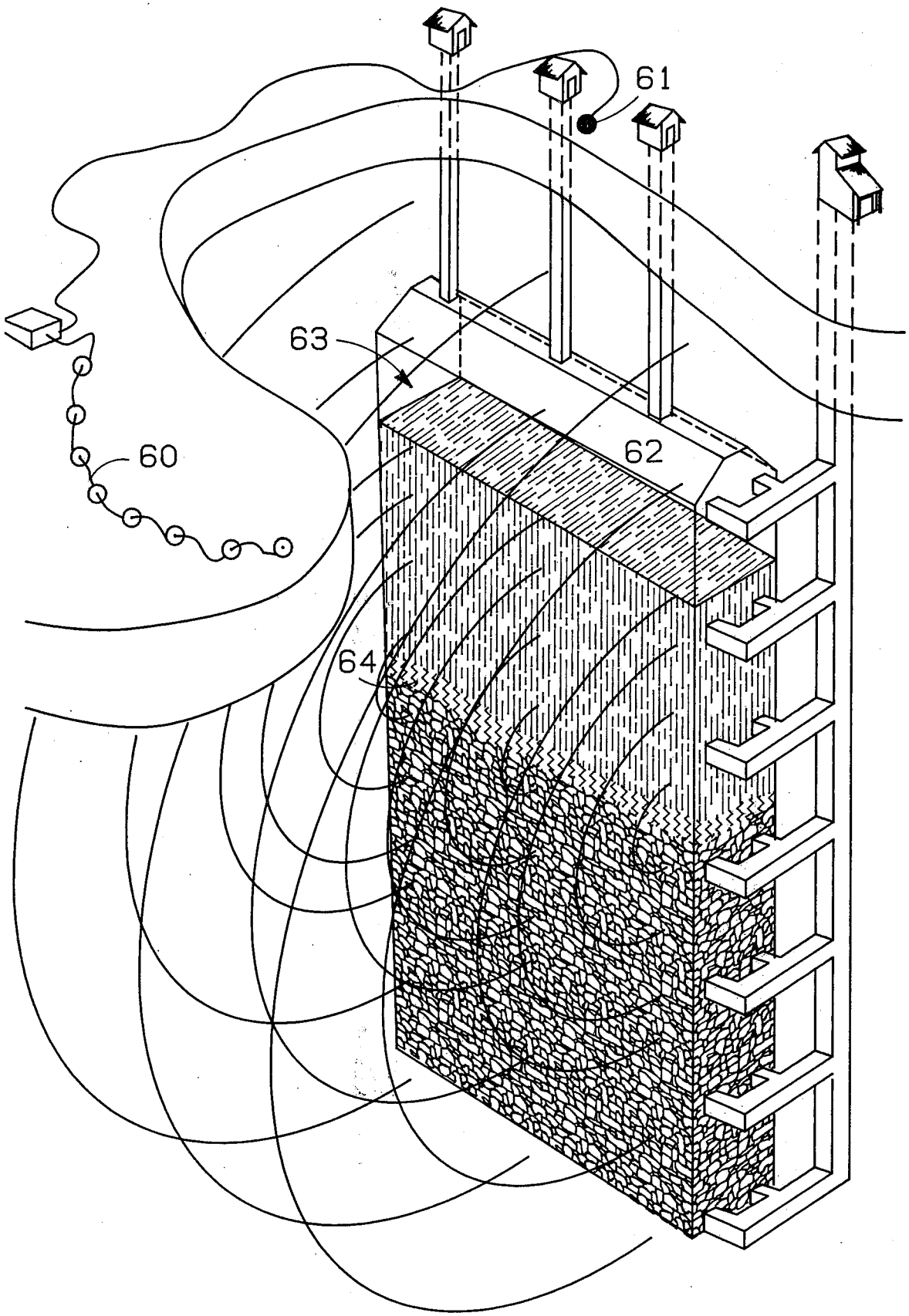
FIG. 3 is a cutaway view illustrating the use of a series of detectors focused at a retort sidewall and a single detector above the sidewall.

In accordance with FIG. 3, one or more detectors 60 are placed at a known distance from a detector 61 placed directly above the rubbled oil shale retort 62 in the plane of the retort sidewall 63. If a plurality of detectors 60 are used, they are preferably placed in an arc to one side of the retort sidewall 63 such that they are focused toward the sidewall 63. The signal received by detectors 60 is cross correlated with the received signal at the detector 61 located above the edge of the retort. From the known position of the rubbled oil shale retort 62 and the detectors, the incremental distance (time delay) derived from the cross correlation of the received signals will triangularize back to the position of the flame front 64 within the burning retort 62. In this case, as opposed to the FIG. 2 case, only two detectors are needed since only the depth to the flamefront is unknown. The two detectors provide one time differential which allows determination of the unknown depth.

In all embodiments, the known positions of the retort and seismic detectors play an integral role in determining the position of the flame front. Since extensive mining and drilling of the region has been performed in preparing the rubbled retort, the nature of the over-burden is usually well known and an average acoustic velocity for computational purposes will be readily available.

The seismic detector means to be employed in the present invention can be any of the well known seismometers commonly used in seismic exploration or acoustic well logging, including geophones, hydrophones, and the like. Preferably, acoustic coupling between the detector and the wellbore should be optimized, thus a pair of matched hydrophones immersed in a liquid-filled well can be used advantageously. Alternatively, contemporary logging tools with good seismometer to formation acoustic coupling can be employed.

The preferred method of employing a pair of matched seismic detectors in a borehole has the advantage relative to the alternative of surface detectors in that acoustical scattering associated with the weathering layer is minimized. In fact, the acoustic energy generated at the flame front will usually travel through a single medium when an observation well technique is employed since the oil shale deposit wherein an in situ retort process is being performed involves a vast substrata deposit of oil shale. Therefore, a single continuous oil shale deposit will exist between the retort sidewall and the wellbore, which simplifies and minimizes the basic interpretation of the seismic signal received. Of course, the additional expense of drilling the observation wells represents an economic incentive to perform the alternate surface detection technique. However, in most cases, a commercial scale oil shale project will involve many rubbled retorts being developed simultaneously in the very close proximity of each other. Thus, a host of observation wells and various mining tunnels will inherently be available to accommodate the seismic detectors without major additional drilling expense. In fact, it is envisioned in performing the method of the present invention that mining shafts, already present because of the creation of the rubbled retort, can be advantageously employed. Such shafts would accommodate either the moving matched pair of seismometers or in the alternative can be utilized to accommodate a vertical array of fixed position matched detectors cemented to the shaft wall to detect the flame front as it passes through the retort.

The concepts of using fixed position detectors either above or below the earth's surface will usually require some processing of the received signals. This necessitates either offline data processing or a dedicated computer. Generally, any of the well known and well documented contemporary seismic data processing techniques are compatible with the present invention. Although such processes involve additional expense, they can be advantageous in establishing the breadth of the flame front, particularly when inadequate combustion in a localized area of the retort is suspected or localized hot spots where the combustion is occurring at an undesirably fast rate is suspected.

Having thus described the preferred embodiments and their respective relative advantages and disadvantages, it should be apparent to one skilled in the art of seismic exploration and seismic interpretation that a great number of modifications in details of the foregoing procedures (not mentioned herein) may be made without departing from the scope of our invention. As such, this disclosure and associated claims should not be interpreted as being unduly limiting.

We claim:

1. A method for determining the position of the flame front within a rubbled oil shale retort of known dimensions and known position during an in situ combustion of said oil shale retort comprising: (a) detecting at a plurality of known positions relative to said oil shale retort the acoustic energy generated by said flame front by moving a pair of matched hydrophones separated by a fixed known distance through a well bore which is liquid-filled and which has been drilled such as to traverse, at a known distance thereto, a sidewall of said retort of which the flame front is intended to pass along during in situ combustion, and (b) determining the position of the source of the acoustic energy from the received signals by leading the outputs from said pair of matched hydrophones to a differential amplifier and recording the resulting difference as a function of the position of said pair of matched hydrophones in said well bore such that a minimum in said resulting difference corresponds to the position of the flame front in said oil shale retort.

2. A method for determining the position of the flame front within a rubbled oil shale retort of known dimensions and known position during an in situ combustion of said oil shale retort comprising: (a) detecting at a plurality of known positions relative to said oil shale retort the acoustic energy generated by said flame front involving three or more seismic detectors positioned along a line on the earth's surface that is essentially perpendicular to the sidewall of said oil shale retort, and (b) determining the position of the source of the acoustic energy from the received signals by determining time shift associated with detector-to-detector cross-correlation curves and then determining the depth of the flame front from these time shifts and respective detector positions.

3. A method of claim 2 wherein said steps are repeated at a plurality of lines on the earth's surface, thus determining the inclination of said flame front.

4. A method for determining the position of the flame front within a rubbled oil shale retort of known dimensions and known position during an in situ combustion of said oil shale retort comprising: (a) detecting at a plurality of known positions relative to said oil shale retort the acoustic energy generated by said flame front involving a first detector placed on the earth's surface directly above the flame front in the plane of the retort sidewall and a second detector placed on the earth's surface, displaced to the formation side of the sidewall, and (b) determining the position of the source of the acoustic energy from the received signals by establishing the time shift associated with the cross-correlation of the seismic signal from said second detector and the signal received at said first detector directly above said flame front and then determining the depth of the flame front from the time shift and the respective detector positions.

5. A method of claim 4 wherein said steps are repeated at a plurality of sidewalls, thus determining the inclination of such flame front.

6. A method according to claim 4 wherein said second detector comprises a plurality of geophones positioned in an arc on the earth's surface focused at the retort sidewall and said geophones and electrically connected together to provide a single composite output signal.

* * * * *

UNITED STATES PATENT OFFICE
CERTIFICATE OF CORRECTION

PATENT NO. : 4,167,213

DATED : September 11, 1979

INVENTOR(S) : Richard A. Stoltz and Albert C. Metrailer

It is certified that error appears in the above-identified patent and that said Letters Patent are hereby corrected as shown below:

Column 2, line 29, after "injection" and before "and" insert ---rate---.
Column 5, line 59, "combination" should read ---combustion---.
Colun 6, line 9, "as" should read ---an---.
line 68, "42" should read ---43---.

Signed and Sealed this

*Eighteenth* Day of *March 1980*

[SEAL]

*Attest:*

*Attesting Officer*

SIDNEY A. DIAMOND

*Commissioner of Patents and Trademarks*